US009987527B1

(12) United States Patent
Myers et al.

(10) Patent No.: US 9,987,527 B1
(45) **Date of Patent: *Jun. 5, 2018**

(54) IRON-TYPE GOLF CLUB HEAD WITH STIFFENING RODS

(71) Applicant: Callaway Golf Company, Carlsbad, CA (US)

(72) Inventors: Matthew Myers, Carlsbad, CA (US); James A. Seluga, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/628,364

(22) Filed: Jun. 20, 2017

Related U.S. Application Data

(63) Continuation-in-part of application No. 15/447,638, filed on Mar. 2, 2017, now Pat. No. 9,687,702, which is a continuation-in-part of application No. 15/279,188, filed on Sep. 28, 2016, now Pat. No. 9,687,701, which is a continuation of application No. 14/847,227, filed on Sep. 8, 2015, now Pat. No. 9,486,677, which is a continuation-in-part of application No. 14/285,479, filed on May 22, 2014, (Continued)

(51) Int. Cl.

| | |
|---|---|
| ***A63B 53/04*** | (2015.01) |
| ***A63B 53/06*** | (2015.01) |
| *A63B 60/42* | (2015.01) |

(52) U.S. Cl.

CPC ..... *A63B 53/0466* (2013.01); *A63B 53/047* (2013.01); *A63B 53/0475* (2013.01); *A63B 60/42* (2015.10); *A63B 2053/0412* (2013.01); *A63B 2053/0416* (2013.01); *A63B 2053/0433* (2013.01); *A63B 2053/0458* (2013.01); *A63B 2053/0491* (2013.01); *A63B 2209/00* (2013.01)

(58) Field of Classification Search

CPC ..... A63B 2053/0458; A63B 53/0475; A63B 2053/0433; A63B 2209/00; A63B 60/42; A63B 2053/0416; A63B 2053/0412; A63B 2053/0491; A63B 53/047; A63B 53/0466

USPC ..... 473/324–350, 287–292

See application file for complete search history.

(56) References Cited

U.S. PATENT DOCUMENTS 5,464,211 A * 11/1995 Atkins, Sr. ..... A63B 53/04 473/346

6,524,197 B2 * 2/2003 Boone ..... A63B 53/0466 473/324

(Continued)

*Primary Examiner* — Sebastiano Passaniti

(74) *Attorney, Agent, or Firm* — Rebecca Hanovice; Michael Catania; Sonia Lari

(57) ABSTRACT

A golf club head having improved stiffness characteristics is disclosed herein. The golf club head, which preferably is an iron-type head, comprises a body with at least two stiffening rods extending between a top portion and a bottom portion or heel and toe portions of the body. The stiffening rods, when tightened, place pressure on one of the top portion and bottom portion, thereby stiffening that portion of the body. The stiffening rods are inserted into the body via internally threaded through-bores or ports, and when tightened, press against receiving cups extending from the top or bottom portions of the body into a rear cavity of the body. The present invention is also directed to a set of such golf club heads with stiffening rods in differing orientations within the heads depending on their loft angles.

14 Claims, 4 Drawing Sheets

Related U.S. Application Data now Pat. No. 9,211,451, which is a continuation-in-part of application No. 13/788,173, filed on Mar. 7, 2013, now Pat. No. 8,926,448, said application No. 14/847,227 is a continuation-in-part of application No. 14/794,578, filed on Jul. 8, 2015, now Pat. No. 9,814,947, and a continuation-in-part of application No. 14/788,326, filed on Jun. 30, 2015, now Pat. No. 9,597,558, said application No. 14/794,578 is a continuation-in-part of application No. 14/755,068, filed on Jun. 30, 2015, now Pat. No. 9,623,302, which is a continuation-in-part of application No. 14/498,843, filed on Sep. 26, 2014, now Pat. No. 9,259,627, which is a continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 62/353,700, filed on Jun. 23, 2016, provisional application No. 61/898,956, filed on Nov. 1, 2013, provisional application No. 61/665,203, filed on Jun. 27, 2012, provisional application No. 61/684,079, filed on Aug. 16, 2012.

(56) References Cited

U.S. PATENT DOCUMENTS 6,558,271 B1 * 5/2003 Beach ..... A63B 53/04 473/327
7,140,977 B2 * 11/2006 Atkins, Sr. ..... A63B 53/0466 473/333
7,351,161 B2 * 4/2008 Beach ..... A63B 53/0466 473/334
7,445,563 B1 * 11/2008 Werner ..... A63B 53/0466 473/332
7,967,700 B2 * 6/2011 Stites ..... A63B 53/0466 473/342
8,758,164 B2 * 6/2014 Breier ..... A63B 53/0466 473/332
8,834,294 B1 * 9/2014 Seluga ..... A63B 53/04 473/338
8,956,244 B1 * 2/2015 Westrum ..... A63B 53/04 473/338
9,067,110 B1 * 6/2015 Seluga ..... A63B 53/06
9,180,349 B1 * 11/2015 Seluga ..... A63B 53/04
9,216,332 B1 * 12/2015 Ehlers ..... A63B 53/06
9,333,390 B1 * 5/2016 Manwaring ..... A63B 24/0003
9,345,936 B1 * 5/2016 Westrum ..... A63B 53/04
9,352,199 B2 * 5/2016 Seluga ..... A63B 53/06
9,486,677 B1 * 11/2016 Seluga ..... A63B 53/0466
9,597,558 B1 * 3/2017 Seluga ..... A63B 53/0466
9,597,561 B1 * 3/2017 Seluga ..... A63B 53/0466
9,623,291 B2 * 4/2017 Greensmith ..... A63B 53/0466
9,687,701 B1 * 6/2017 Seluga ..... A63B 53/0466
9,687,702 B1 * 6/2017 Seluga ..... A63B 53/0466
9,694,257 B1 * 7/2017 Seluga ..... A63B 53/0466
9,757,629 B2 * 9/2017 Seluga ..... A63B 53/0466
9,776,058 B2 * 10/2017 Seluga ..... A63B 53/0466
9,814,947 B1 * 11/2017 Seluga ..... A63B 53/0466
9,821,199 B1 * 11/2017 Seluga ..... A63B 53/0466
9,827,469 B1 * 11/2017 Seluga ..... A63B 53/0466
2002/0169036 A1 * 11/2002 Boone ..... A63B 53/0466 473/346
2009/0298613 A1 * 12/2009 Hirsch ..... A63B 53/0466 473/346
2010/0273565 A1 * 10/2010 Stites ..... A63B 53/04 473/282
2014/0004972 A1 * 1/2014 Thomas ..... A63B 53/0466 473/332

* cited by examiner

IRON-TYPE GOLF CLUB HEAD WITH STIFFENING RODS

CROSS REFERENCES TO RELATED APPLICATIONS

The present application claims priority to U.S. Provisional Patent Application No. 62/353,700, filed on Jun. 23, 2016, and is also a continuation-in-part of U.S. patent application Ser. No. 15/447,638, filed on Mar. 2, 2017, and issued on Jun. 27, 2017, as U.S. Pat. No. 9,687,702, which is a continuation-in-part of U.S. patent application Ser. No. 15/279,188, filed on Sep. 28, 2016, and issued on Jun. 27, 2017, as U.S. Pat. No. 9,687,701, which is a continuation of U.S. patent application Ser. No. 14/847,227, filed on Sep. 8, 2015, and issued on Nov. 8, 2016, as U.S. Pat. No. 9,486,677, which is a continuation-in-part of U.S. patent application Ser. No. 14/285,479, filed on May 22, 2014, and issued on Dec. 15, 2015, as U.S. Pat. No. 9,211,451, which is a continuation-in-part of U.S. patent application Ser. No. 13/788,173, filed on Mar. 7, 2013, and issued on Jan. 6, 2015, as U.S. Pat. No. 8,926,448, and also is a continuation-in-part of U.S. patent application Ser. No. 14/788,326, filed on Jun. 30, 2015, and issued on Mar. 21, 2017, as U.S. Pat. No. 9,597,558, and also is a continuation-in-part of U.S. patent application Ser. No. 14/794,578, filed on Jul. 8, 2015, which is a continuation-in-part of U.S. patent application Ser. No. 14/755,068, filed on Jun. 30, 2015, and issued on Apr. 18, 2017, as U.S. Pat. No. 9,623,302, which is a continuation-in-part of U.S. patent application Ser. No. 14/498,843, filed on Sep. 26, 2014, and issued on Feb. 16, 2016, as U.S. Pat. No. 9,259,627, which is a continuation-in-part of U.S. patent application Ser. No. 14/173,615, filed on Feb. 5, 2014, and issued on Nov. 10, 2015, as U.S. Pat. No. 9,180,349, which claims priority to U.S. Provisional Patent Application No. 61/898,956, filed on Nov. 1, 2013, and which is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, now abandoned, which claims priority to U.S. Provisional Patent Application No. 61/665,203, filed on Jun. 27, 2012, and 61/684,079, filed on Aug. 16, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to an iron-type golf club head, and a set of such golf club heads, with optimized stiffness features. In particular, the golf club head of the present invention includes one or more stiffening structures that connect the bottom portion of the head to the top line of the head, thereby attenuating motion of at least one of the top and bottom portions of the head and reducing stress in the face upon impact with a golf ball.

Description of the Related Art

Golfers often prefer to use irons with thin, mostly unsupported faces in order to increase ball speed off the face, improve forgiveness, and generally improve their performance on the golf course. Unfortunately, open backed irons with thin, unsupported faces typically do not have the sound and feel desired by golfers. This problem can be fixed by fully enclosing the back of such a cavity back iron, but a fully enclosed cavity construction raises the iron's center of gravity and thus negatively affects the iron's mass properties and performance. Therefore, there is a need for a high performance iron with both a thin, unsupported face and an open cavity back with sufficient stiffness for desirable performance.

BRIEF SUMMARY OF THE INVENTION

The present invention is directed to a golf club head with optimized stiffness characteristics, and a set of such golf club heads with top and bottom stiffnesses that vary across the set. The golf club heads preferably are irons, and include stiffening rods that extend between the top line and the bottom portion and preload at least a portion of the body of the golf club head, thus optimizing the trajectory of a golf ball upon impact. The invention disclosed herein can be used in connection with closed and open backed irons, and can also be used in connection with other types of golf club heads.

One aspect of the present invention is an iron-type golf club head comprising a body comprising a top portion, a bottom portion, a heel side, a toe side, a striking face, a rear cavity, at least one internally threaded through-bore in communication with the rear cavity, and at least one receiving cup extending into the rear cavity, and at least one stiffening rod comprising a threaded head portion sized to engage at the at least one internally threaded through-bore, a middle portion sized to extend between the at least one receiving cup and the at least one internally threaded through-bore, and an end portion sized to fit within the at least one receiving cup, wherein the at least one receiving cup is aligned with the at least one internally threaded through-bore along an axis that extends through the rear cavity, and wherein when the at least one stiffening rod is engaged with the body, tightening the at least one stiffening rod increases a stiffness of at least a portion of the body. In some embodiments, the at least one receiving cup may be affixed to the top portion, and the at least one internally threaded through-bore may extend through at least one of the heel side and the toe side, or may extend through the bottom portion.

In an alternative embodiment, the at least one receiving cup may be affixed to the bottom portion and the at least one internally threaded through-bore may extend through the top portion. In other embodiments, the at least one receiving cup may be integrally formed with the body. In some embodiments, the end portion may be tapered, and in others the at least one stiffening rod may be two stiffening rods, the at least one receiving cup may be two receiving cups, and the at least one internally threaded through-bore may be two internally threaded through-bores.

Another aspect of the present invention is a golf club head comprising a body comprising a top portion, a bottom portion, a heel side, a toe side, a front opening, a rear cavity, first and second internally threaded through-bores in communication with the rear cavity, and first and second receiving cups extending into the rear cavity from one of the top portion and the bottom portion, a face component comprising a striking face and a flange, and first and second stiffening rods, wherein the face component is sized to close the front opening, wherein each of the first and second stiffening rods comprises a threaded head portion sized to engage one of the first and second internally threaded through-bores, a middle portion sized to extend between one of the first and second receiving cups and one of the first and second internally threaded through-bores, and an end portion sized to fit within one of the first and second receiving cups, wherein the first receiving cup is aligned with the first internally threaded through-bore along a first axis extending through the rear cavity, and wherein the second receiving cup is aligned with the second internally threaded through-bore along a second axis extending through the rear cavity.

In some embodiments, the golf club head may be selected from the group consisting of an iron-type head, a putter-type head, a wood-type head, and a hybrid-type head. In other embodiments, the flange may extend away from a bottom portion of the striking face and the body may comprise a cutout sized to receive the flange. In still other embodiments, each of the body, face component, and first and second stiffening rods may be composed of a metal alloy.

Yet another aspect of the present invention is an iron-type golf club head comprising a metal body comprising a top portion, a bottom portion, a heel side, a toe side, a striking face, a rear cavity, at least one internally threaded through-bore in communication with the rear cavity, and at least one receiving cup extending from the top portion into the rear cavity, and at least one stiffening rod comprising an end portion disposed within the least one receiving cup, a threaded head portion at least partially disposed within and engaging the at least one internally threaded through-bore, and a middle portion extending between the end portion and the threaded head portion, wherein the at least one internally threaded through bore extends through at least one of the bottom portion, heel side, and toe side, wherein the at least one receiving cup is aligned with the at least one internally threaded through-bore along an axis that extends through the rear cavity approximately parallel with a rear surface of the striking face, wherein the middle portion extends approximately parallel with the rear surface of the striking face, wherein no portion of the at least one stiffening rod makes contact with the rear surface of the striking face, and wherein the at least one stiffening rod attenuates movement of at least one of the top portion and the bottom portion when the striking face impacts a golf ball.

In some embodiments, the at least one stiffening rod may be spaced from 0.136 inch to 0.210 inch from the rear surface of the striking face. In other embodiments, the at least one stiffening rod may be a solid metal rod, and wherein the end portion may be tapered. In still other embodiments, tightening the at least one stiffening rod may increase a stiffness of the top portion with respect to the rest of the body. In other embodiments, each of the body and at least one stiffening member may be composed of a material selected from the group consisting of stainless steel, carbon steel, and titanium alloy. In yet another embodiment, the at least one stiffening rod may comprise first and second stiffening rods, which may extend at an angle of less than 90° with respect to one another.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
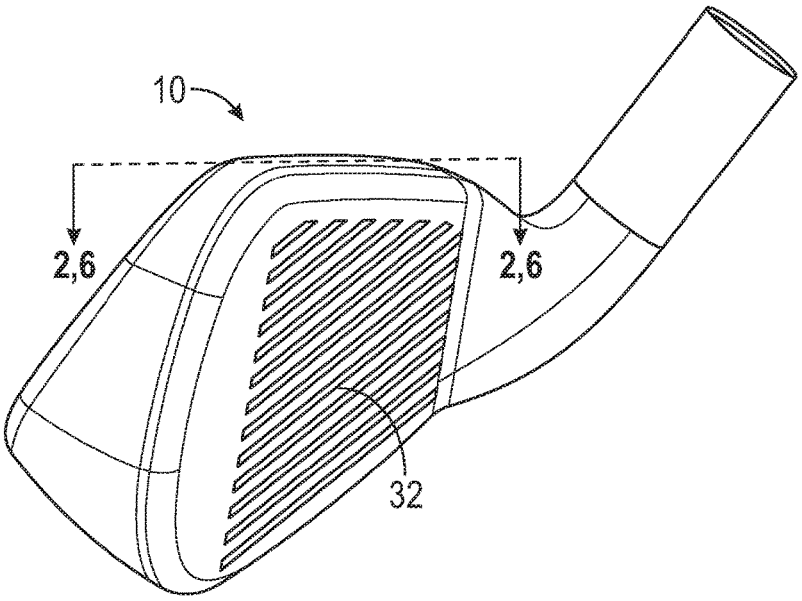
FIG. 1 is a front perspective view of a golf club head according to the present invention.
Figure 2:
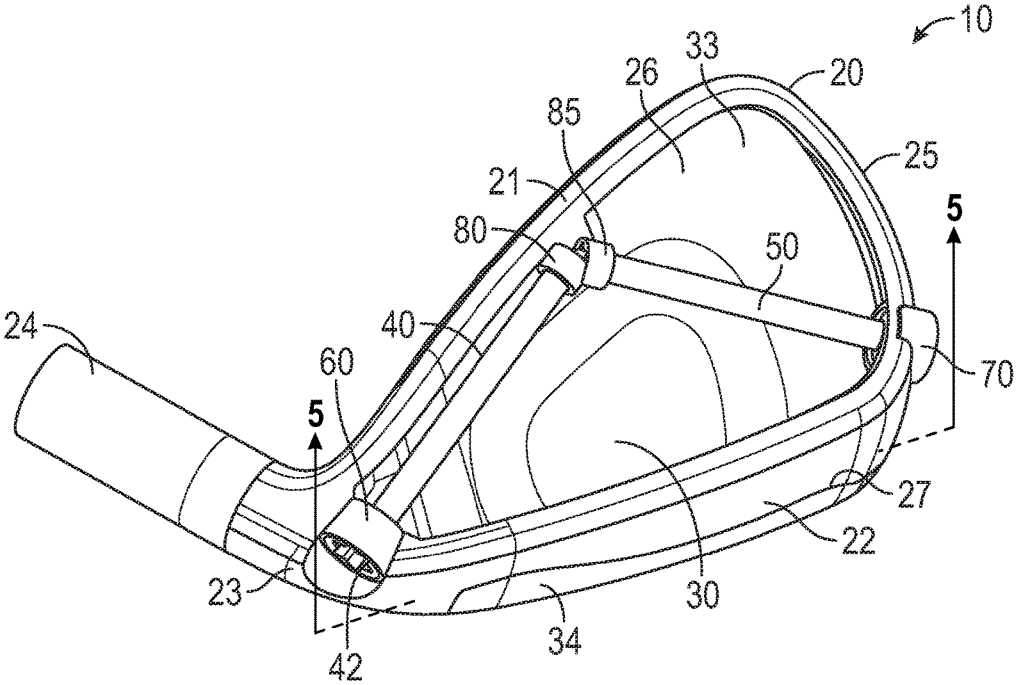
FIG. 2 is a cross-sectional view of the golf club head shown in FIG. 1 along lines 2-2.
Figure 3:
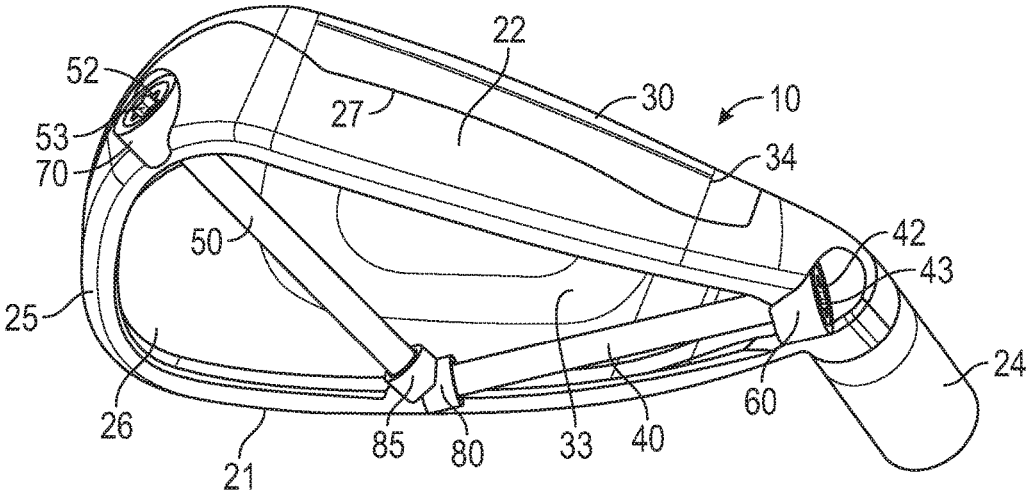
FIG. 3 is a bottom elevational view of the golf club head shown in FIG. 2.
Figure 4:
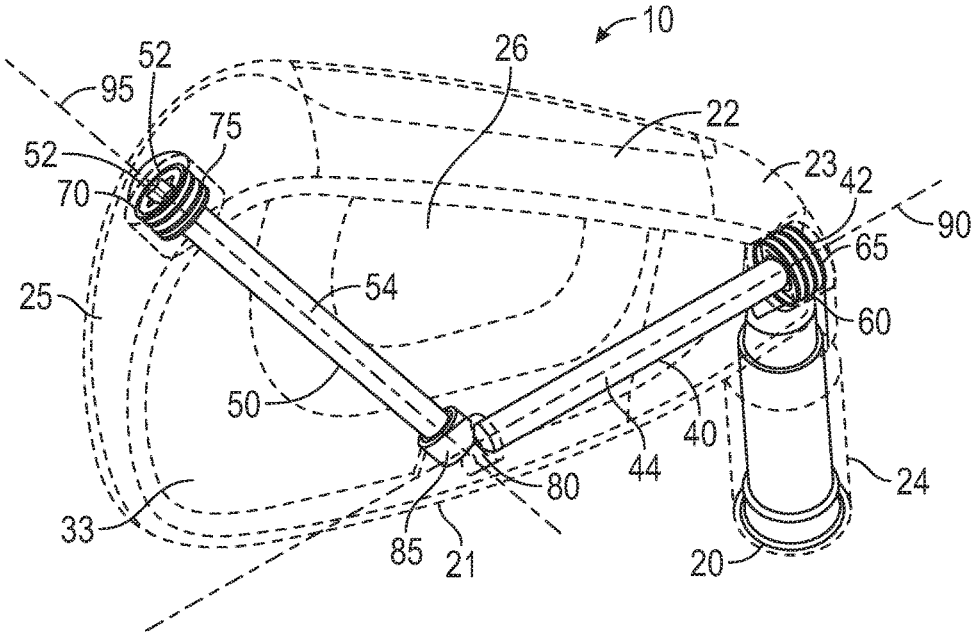
FIG. 4 is a partially transparent view of the golf club head shown in FIG. 2.
Figure 5:
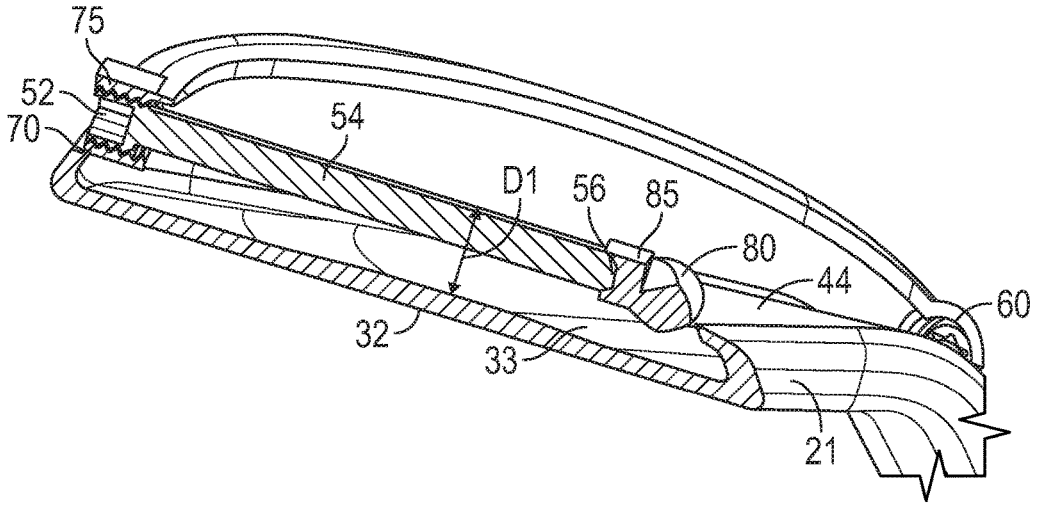
FIG. 5 is a cross-sectional view of the golf club head shown in FIG. 2 along lines 5-5.

The present invention is generally directed to an iron-type golf club head with an adjustable stiffening system, which, by connecting the top portion of the club head to the bottom of the club head, creates the sound and feel of a closed cavity back iron while at the same time providing the desirable performance and mass properties of an open cavity back iron, including improved golf ball trajectories after impact. The present invention is also directed to a set of iron-type golf club heads with stiffening rods that have different orientations across the set. For example, higher lofted irons may have the stiffening rods oriented to provide stiffer top lines, while lower lofted iron may have the stiffening rods oriented to have stiffer bottom portions, and vice versa. Either way, the stiffening rods attenuate movement of the top line and/or bottom portion of the club head when the striking face of the club head impacts a golf ball.

In the preferred embodiment, shown in FIGS. 1-5, the iron-type golf club head 10 comprises a body 20, a face component 30 having a striking face 32 and a flange or sole extension 34, and two stiffening rods 40, 50 extending at a greater than 90° angle to one another. The body 20 includes a top portion 21, a bottom portion 22, a heel side 23, a hosel 24, a toe side 25, a rear cavity 26 defined by a rear surface 33 of the striking face 32 and the top and bottom portions 21, 22 of the body 20, and a cutout 27 in the bottom portion 22 sized to receive the sole extension 34. The heel side 23 of the body 20 includes a heel-side port 60 proximate the bottom portion 22, and the toe side 25 of the body 20 includes a toe-side port 70 proximate the bottom portion 22, each of which have internal threading 65, 75 and act as through-bores that communicate with the rear cavity 26. The top portion 21 of the body 20 also includes a pair of receiving cups 80, 85 extending from a central location of the top portion 21 into the rear cavity 26, each of which has an axis 90, 95 that is aligned with of one of the heel-side and toe-side ports 60, 70.

As shown in FIGS. 2-5, the stiffening rods 40, 50 each comprise an externally threaded head portion 42, 52 sized to engage the ports 60, 70, a middle portion 44, 54 sized to extend through the rear cavity 26 of the body 20 approximately parallel with the rear surface of the striking face 32, and a tapered end portion 46, 56 sized to engage the receiving cups 80, 85. The head portion 42, 52 also includes tool engaging features 43, 53 such that a user can adjust the stiffening rods 40, 50 with a screwdriver, Torq® wrench, or other tool known to a person skilled in the art. Each stiffening rod 40, 50 is engaged with the body 20 by inserting the tapered end portion 46, 56, and middle portion 44, 54 into one of the ports 60, 70 until the tapered end portion 46, 56 docks within a receiving cup 80, 85 and the threads of the head portion 42, 52 mate with the internal threads 65, 75 of the port 60, 70. The stiffness of the top portion 21 can then be adjusted by tightening or loosening the stiffening rod 40, 50 within the body 20, such that more or less pressure is placed on the receiving cup 80, 85, and therefore the top portion 21. Once the stiffening rod 40, 50 is fixed within the body 20 and the top portion 21 has a desired stiffness with respect to the rest of the body 20, the stiffening rod 40, 50 can be permanently affixed to the body 20 with an adhesive such as Loctite® or by welding, brazing, soldering, or other means known to a person skilled in the art.

Figure 6:
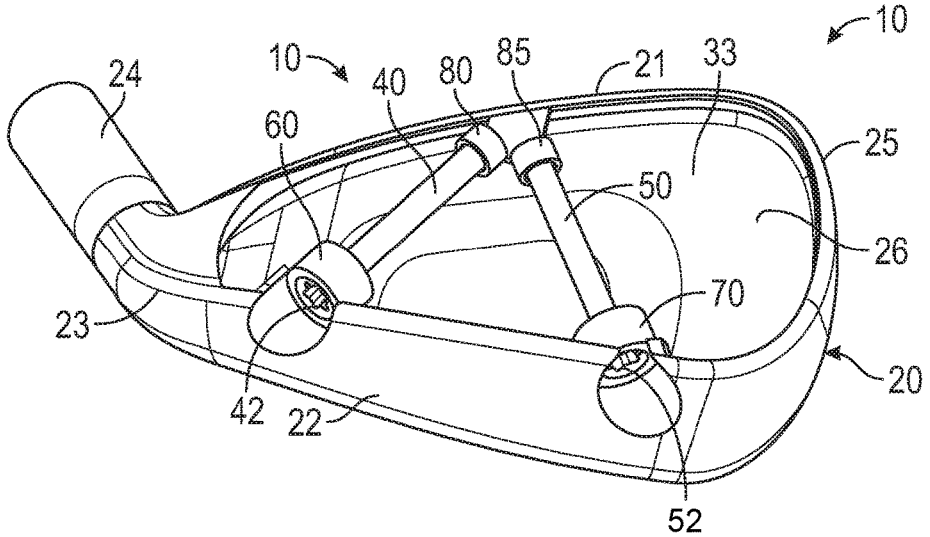
FIG. 6 is a cross-sectional view of another embodiment of the golf club head shown in FIG. 1 along lines 6-6.
Figure 7:
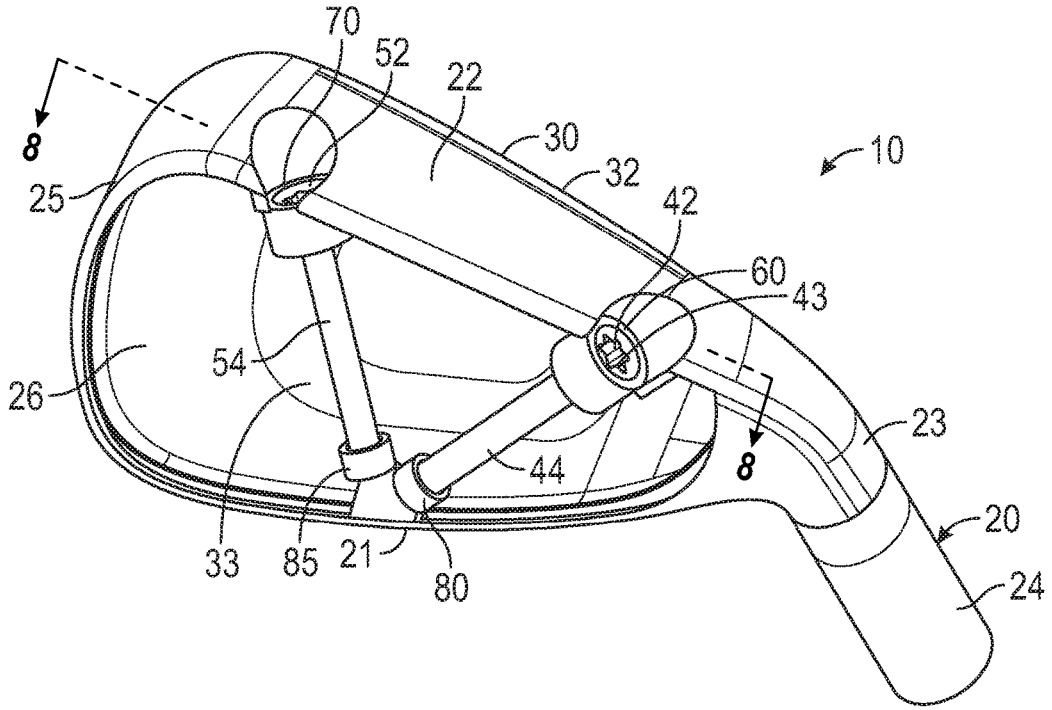
FIG. 7 is a bottom elevational view of the golf club head shown in FIG. 6.
Figure 8:
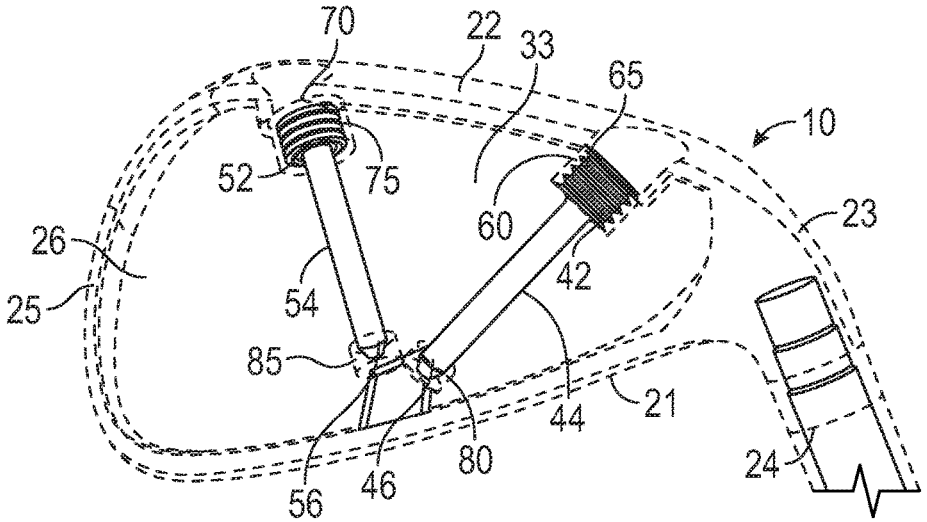
FIG. 8 is a partially transparent, cross-sectional view of the golf club head shown in FIG. 7 along lines 8-8.

In another embodiment, shown in FIGS. 6-8, the iron-type golf club head 10 has all of the same features as the preferred embodiment, except that the ports 60, 70 are disposed in the bottom portion 22 instead of in the heel and toe sides 23, 25 of the body 20 and the stiffening rods 50, 60 extend at an angle of 90° or less with respect of one another. Furthermore, in this embodiment, the face component 30 is not a partial face cup, such as the one shown in FIGS. 2-5, but instead is simply a face insert comprising a striking face 32.

In yet another embodiment (not shown), the location of the ports 60, 70 and receiving cups 80, 85 may be inverted, such that the receiving cups 80, 85 extend into the rear cavity 26 from the bottom portion 22 and the ports 60, 70 extend into the rear cavity 26 from the top portion 21. In this orientation, the stiffening rods 40, 50 can be used to stiffen the bottom portion 22 instead of the top portion 21. Yet another embodiment of the present invention is a set of these iron-type golf club heads 10, each of which has its ports 60, 70 and receiving cups 80, 85, and therefore stiffening rods 40, 50, in different orientations in the body 20, such that the stiffness of the top portion 21 and bottom portion 22 differs depending on the loft of the iron-type golf club head 10.

For each of the embodiments disclosed herein, the body 20, the face component 30, and the stiffening rods 40, 50 may be formed from any suitable material, including but not limited to stainless steel, carbon steel, and titanium alloy. The ports 60, 70 and receiving cups 80, 85 preferably are integrally formed with the body 20, but in other embodiments may be affixed to the body 20 by welding, brazing, soldering, or other means known to a person skilled in the art. As shown in the Figures, the stiffening rods 40, 50 preferably are solid rods composed of a lightweight, strong metal material, though in an alternative embodiment one or both of the stiffening rods 40, 50 may be a hollow tube or other structure made of a strong, lightweight metal material or composite material.

In all of the embodiments disclosed herein, at least the middle portion 44, 54 of each stiffening rod 40, 50 extends approximately parallel with the rear surface 33 of the striking face 32 without touching any portion of the striking face 32. In fact, is preferable that no portion of either stiffening rod 40, 50 makes contact with the rear surface 33 of the striking face 32, even when the striking face 32 impacts a golf ball. Furthermore, each of the stiffening rods 40, 50 is preferably located a distance $D_1$ of within 1 inch of the rear surface 33 of the striking face 32. No portion of either stiffening rod 40, 50 should be located outside of this 1-inch range; in fact, it is more preferable for each stiffening rod 40, 50 to be located even closer to the rear surface 33 of the striking face 32, preferably within 0.250 inch, and most preferably within a range of 0.136 inch to 0.210 inch from the rear surface 33.

Though the invention disclosed herein is shown in connection with an iron-type golf club head, it may also be used to stiffen various structural elements of wood-type heads, hybrid-type heads, putter-type heads, and wedge-type heads.

The disclosure of each of U.S. Provisional Patent Application No. 62/424,223, U.S. patent application Ser. Nos. 14/812,971, 15/167,588, and 15/392,818, and U.S. Pat. No. 9,675,852 is hereby incorporated by reference in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An iron-type golf club head comprising:

a body comprising a top portion, a bottom portion, a heel side, a toe side, a striking face, a rear cavity, at least one internally threaded through-bore extending through the top portion in communication with the rear cavity, and at least one receiving cup extending from the bottom portion into the rear cavity; and at least one stiffening rod comprising a threaded head portion sized to engage at the at least one internally threaded through-bore, a middle portion sized to extend between the at least one receiving cup and the at least one internally threaded through-bore, and an end portion sized to fit within the at least one receiving cup, wherein the at least one receiving cup is aligned with the at least one internally threaded through-bore along an axis that extends through the rear cavity approximately parallel with a rear surface of the striking face, wherein when the at least one stiffening rod is engaged with the body, the at least one stiffening rod is located within 0.250 inch of the rear surface of the face, and tightening the at least one stiffening rod increases a stiffness of at least a portion of the body, wherein no portion of the at least one stiffening rod makes contact with the rear surface of the striking face when the striking face impacts a golf ball, and wherein the at least one stiffening rod attenuates movement of at least one of the top portion and the bottom portion when the striking face impacts a golf ball.

2. The iron-type golf club head of claim 1, wherein the at least one receiving cup is integrally formed with the body.

3. The iron-type golf club head of claim 1, wherein the end portion is tapered.

4. The iron-type golf club head of claim 1, wherein the at least one stiffening rod is two stiffening rods, wherein the at least one receiving cup is two receiving cups, and wherein the at least one internally threaded through-bore is two internally threaded through-bores.

5. A golf club head comprising:

a body comprising a top portion, a bottom portion, a heel side, a toe side, a front opening, a rear cavity, first and second internally threaded through-bores extending through one of the top portion and the bottom portion in communication with the rear cavity, and first and second receiving cups extending into the rear cavity from the other of the top portion and the bottom portion;

a face component comprising a striking face and a flange; and first and second stiffening rods, wherein the face component is sized to close the front opening, wherein each of the first and second stiffening rods comprises a threaded head portion sized to engage one of the first and second internally threaded through-bores, a middle portion sized to extend between one of the first and second receiving cups and one of the first and second internally threaded through-bores, and an end portion sized to fit within one of the first and second receiving cups, wherein, when each of the first and second stiffening rods is fully engaged with the body, each of the first and second stiffening rods is located within 0.250 of the rear surface of the face, and no portion of either of the first and second stiffening rods makes contact with the rear surface of the striking face when the striking face impacts a golf ball, wherein the first receiving cup is aligned with the first internally threaded through-bore along a first axis extending through the rear cavity approximately parallel with a rear surface of the striking face, and wherein the second receiving cup is aligned with the second internally threaded through-bore along a second axis extending through the rear cavity approximately parallel with a rear surface of the striking face.

6. The golf club head of claim 5, wherein the golf club head is selected from the group consisting of an iron-type head, a putter-type head, a wood-type head, and a hybrid-type head.

7. The golf club head of claim 5, wherein the flange extends away from a bottom portion of the striking face, and wherein the body comprises a cutout sized to receive the flange.

8. The golf club head of claim 5, wherein each of the body, the face component, and the first and second stiffening rods is composed of a metal alloy.

9. An iron-type golf club head comprising:

a metal body comprising a top portion, a bottom portion, a heel side, a toe side, a striking face, a rear cavity, at least one internally threaded through-bore in communication with the rear cavity, and at least one receiving cup extending from the top portion into the rear cavity; and at least one stiffening rod comprising an end portion disposed within the at least one receiving cup, a threaded head portion at least partially disposed within and engaging the at least one internally threaded through-bore, and a middle portion extending between the end portion and the threaded head portion, wherein the at least one internally threaded through-bore extends through at least one of the bottom portion, heel side, and toe side, wherein the at least one receiving cup is aligned with the at least one internally threaded through-bore along an axis that extends through the rear cavity approximately parallel with a rear surface of the striking face, wherein the middle portion extends approximately parallel with the rear surface of the striking face, wherein no portion of the at least one stiffening rod makes contact with the rear surface of the striking face when the striking face impacts a golf ball, wherein the at least one stiffening rod is located within 0.250 inch of the rear surface of the face, and wherein the at least one stiffening rod attenuates movement of at least one of the top portion and the bottom portion when the striking face impacts a golf ball.

10. The iron-type golf club head of claim 9, wherein the at least one stiffening rod is spaced from 0.136 inch to 0.210 inch from the rear surface of the striking face.

11. The iron-type golf club head of claim 9, wherein the at least one stiffening rod is a solid metal rod, and wherein the end portion is tapered.

12. The iron-type golf club head of claim 9, wherein tightening the at least one stiffening rod increases a stiffness of the top portion with respect to the rest of the body.

13. The iron-type golf club head of claim 9, wherein each of the body and the at least one stiffening member is composed of a material selected from the group consisting of stainless steel, carbon steel, and titanium alloy.

14. The iron-type golf club head of claim 9, wherein the at least one stiffening rod comprises first and second stiffening rods, and wherein the first and second stiffening rods extend at an angle of less than 90° with respect to one another.

* * * * *